US007235923B2

(12) United States Patent
Moon et al.

(10) Patent No.: US 7,235,923 B2
(45) Date of Patent: Jun. 26, 2007

(54) PLASMA DISPLAY APPARATUS

(75) Inventors: Cheol-Hee Moon, Suwon-si (KR); Chang-Seok Rho, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 22 days.

(21) Appl. No.: 11/063,746

(22) Filed: Feb. 24, 2005

(65) Prior Publication Data

US 2005/0184663 A1 Aug. 25, 2005

(30) Foreign Application Priority Data

Feb. 25, 2004 (KR) ..... 10-2004-0012616

(51) Int. Cl.
*H01J 17/49* (2006.01)

(52) U.S. Cl. ..... 313/582; 313/583; 313/585

(58) Field of Classification Search ..... 313/582, 313/583, 584, 585, 586, 587, 567; 315/169.1, 315/169.3; 445/24, 25; 248/917; 345/60; 361/681, 682; 220/2.1 R, 2.3 R
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto et al. | |
| 6,259,505 | B1 | 7/2001 | Makino | |
| RE37,444 | E | 11/2001 | Kanazawa | |
| 6,628,074 | B1 * | 9/2003 | Saito et al. | 313/582 |
| 6,630,916 | B1 | 10/2003 | Shinoda | |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Mariceli Santiago
*Assistant Examiner*—Anne M Hines
(74) *Attorney, Agent, or Firm*—Robert E. Bushnell, Esq.

(57) ABSTRACT

A plasma display apparatus comprises: a plasma display panel including first and second substrates disposed in opposition to one another with a gap formed therebetween; a chassis base disposed on one side of the plasma display panel; and a drive circuit disposed on an opposite side of the chassis base for driving the plasma display panel. The first and second substrates of the plasma display panel form an overlapping region in which the first and second substrates overlie one another, and at least one pair of non-overlapping regions in which the first and second substrates do not overlie one another. The non-overlapping regions are asymmetrically formed about the overlapping region.

18 Claims, 4 Drawing Sheets

U.S. PATENT DOCUMENTS

| | | | | |
|---|---|---|---|---|
| 6,707,436 | B2 | 3/2004 | Setoguchi et al. | |
| 6,923,703 | B2 * | 8/2005 | Furukawa | 445/24 |
| 2001/0051585 | A1 * | 12/2001 | Ryu et al. | 501/76 |
| 2003/0214614 | A1 * | 11/2003 | Chung | 349/58 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| KR | 10-2001-0005572 | 1/2001 |

* cited by examiner

PLASMA DISPLAY APPARATUS

CLAIM OF PRIORITY

This application makes reference to, incorporates the same herein, and claims all benefits accruing under 35 U.S.C. §119 from an application entitled PLASMA DISPLAY APPARATUS filed with the Korean Intellectual Property Office on 25 Feb. 2004, and there duly assigned Serial No. 10-2004-0012616.

BACKGROUND OF THE INVENTION

1. Technical Field

The present invention relates to a plasma display apparatus and, more particularly, to a plasma display apparatus in which the formation of non-overlapping regions between front and rear substrates of a panel is optimized to realize a more compact overall structure.

2. Description of the Related Art

A plasma display panel (PDP) provided in a plasma display apparatus is a display device that realizes the display of images through excitation of phosphors by plasma discharge. That is, vacuum ultraviolet (VUV) rays emitted from plasma obtained via gas discharge excite phosphor layers, which then emit visible red (R), green (G), and blue (B) light to thereby form images. The PDP has many advantages, including the ability to be made in large screen sizes of 60 inches and greater, a thin profile of 10 cm or less, a wide viewing angle, good color reproduction due to the self-emissive nature of the PDP (as in the case of cathode ray tubes), and high productivity and low manufacturing cost as a result of manufacturing processes that are simpler than those involved with liquid crystal displays. As a result, the PDP is experiencing increasingly widespread use in the home and in industry.

The plasma display apparatus has the following basic structure. A chassis base, which is made of a sturdy material with a high thermal conductivity, such as aluminum, is sandwiched between a PDP and drive circuits. The drive circuits generate signals for operating the PDP. A front cover is mounted on a front surface of the PDP, and a rear cover is mounted on a rear side of the drive circuits, thereby completing fabrication and assembly of the plasma display apparatus.

The PDP is classified as a DC-type device or an AC-type device depending on the drive voltage waveform applied thereto, and is further classified as an opposing discharge-type device or a surface discharge-type device depending on the structure of the discharge cells and the formation of the electrodes in the PDP.

In the AC-type, surface discharge-type PDP, which is the most common configuration, sustain electrodes, scan electrodes and address electrodes interact to effect plasma discharge in the PDP, thereby realizing the display of images. The sustain electrodes and the scan electrodes typically extend to right and left areas of the panel, and are connected to drive circuits provided in the rear of the PDP through an electrical coupling means, such as a flexible printed circuit (FPC). The address electrodes extend to upper and/or lower areas of the PDP, and are connected to drive circuits in a manner similar to connection of the sustain and scan electrodes. Accordingly, terminal sections of all of the electrodes are exposed at edge portions of the PDP so as to allow for connection with FPCs. The front and rear substrates of the PDP, which are sealed in positions opposing one another, are made in different sizes such that non-overlapping regions are formed along edges thereof.

In conventional PDPs, such non-overlapping regions are symmetrically formed such that their widths are identical between the upper and lower areas of the PDP, as well as between the right and left areas of the PDP. In the triode surface discharge PDP, the scan electrodes are individually separated since these electrodes are involved in reset and addressing discharge. In contrast, the terminals of the sustain electrodes are provided in close proximity and are all shorted. Therefore, although the non-overlapping regions must be provided with a substantial width in the areas of the terminals of the scan electrodes, this is not the case with respect to the areas of the terminals of the sustain electrodes.

Furthermore, when single scanning is employed, as opposed to dual scanning wherein the address electrodes extend to both upper and lower areas of the PDP, it is not necessary that non-overlapping regions be provided on the side where the address electrodes do not extend. Thus, such symmetrical formation of the non-overlapping regions results in wasted space when single scanning is employed.

SUMMARY OF THE INVENTION

The present invention comprises a plasma display apparatus in which non-overlapping regions between front and rear substrates are formed in regions where electrodes are extended. The non-overlapping regions are formed asymmetrically as needed, thereby realizing a more compact overall structure of the plasma display apparatus.

The plasma display apparatus comprises: a plasma display panel (PDP) which includes a first substrate and a second substrate sealed in positions opposing one another with a gap formed therebetween, the PDP having a plasma discharge structure in the gap between the first and second substrates; a chassis base mounted adjacent to one side of the PDP and substantially parallel to the PDP; and a drive circuit mounted on a side of the chassis base opposite the side adjacent to the PDP, the drive circuit being electrically connected to the PDP so as to drive the same. The first and second substrates of the PDP form an overlapping region where the first and second substrates overlie one another, and at least one pair of non-overlapping regions is formed where the first and second substrates do not overlie one another. The non-overlapping regions are asymmetrically formed about the overlapping region.

The asymmetrically formed non-overlapping regions have different widths, each of the widths being formed as an average distance between a corresponding adjacent edge of the overlapping region and an outermost edge of the corresponding non-overlapping region.

The first and second electrodes are formed in a substantially uniform manner with respect to one edge of the PDP, and they extend into non-overlapping regions on opposite sides of the PDP. Terminal regions of the first electrodes are shorted in close proximity to one another, and the width of the non-overlapping region into which the second electrodes extend is greater than the width of the non-overlapping region into which the first electrodes extend.

The width of the non-overlapping region, into which the second electrodes extend, is greater than the width of the non-overlapping region, into which the first electrodes extend by 5 to 30 mm.

The address electrodes extend into one of the non-overlapping regions, and the width of the non-overlapping region into which the address electrodes extend is greater than a width of the non-overlapping region positioned on an opposite side of the PDP.

The width of the non-overlapping region, into which the address electrodes extend, is greater than the width of the non-overlapping region positioned on the opposite side of the plasma display panel by 5 to 30 mm.

Alternatively, substantially no non-overlapping region is present on a side of the PDP opposite the non-overlapping region into which the address electrodes extend.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Exemplary embodiments of the present invention will now be described with reference to the drawings.

Figure 1:
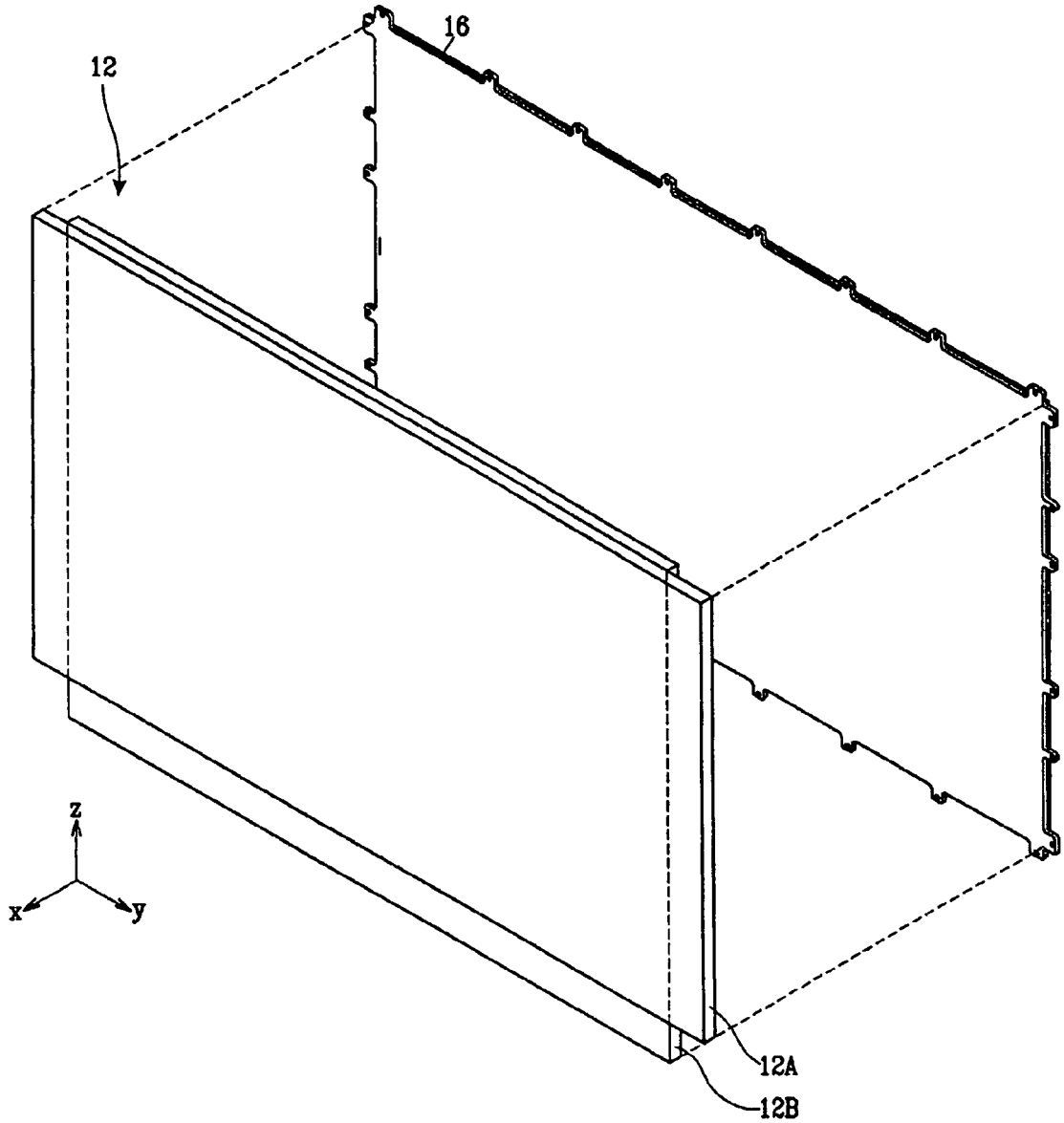
FIG. 1 is an exploded perspective view of a plasma display apparatus according to a first exemplary embodiment of the present invention.
Figure 2:
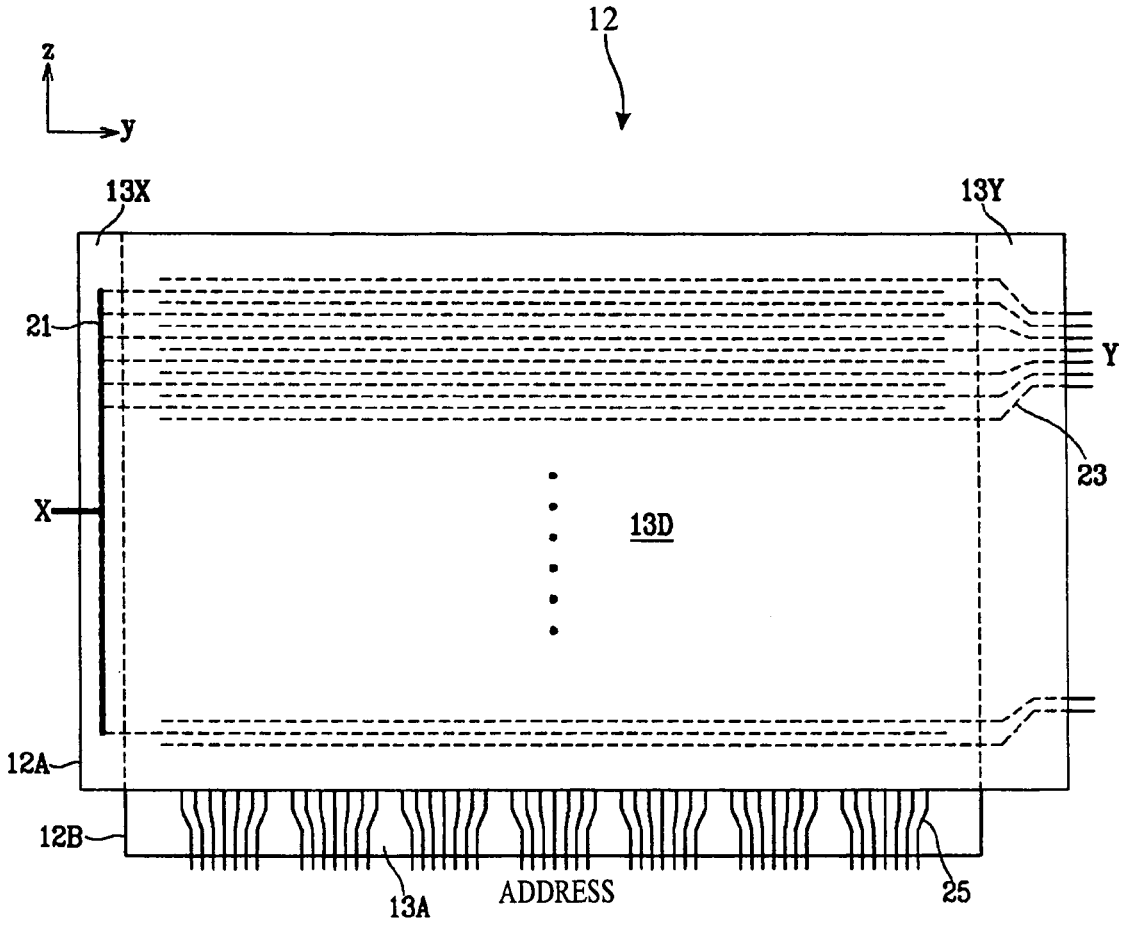
FIG. 2 is a schematic plan view of the PDP of FIG. 1 used to illustrate a mounting structure between front and rear substrates.

FIG. 1 is an exploded perspective view of a plasma display apparatus according to a first exemplary embodiment of the present invention, and FIG. 2 is a schematic plan view of the PDP used to illustrate a mounting structure between front and rear substrates.

The plasma display apparatus includes the main elements of a PDP 12 and a chassis base 16, which are provided substantially parallel to one another. The PDP 12 is mounted on one side of the chassis base 16, and drive circuits (not shown) for driving the PDP 12 are mounted on an opposite side of the chassis base 16. A front cover (not shown) is positioned on an outer surface of the PDP 12 (i.e., on a side opposite that side adjacent to the chassis base 16), and a rear cover (not shown) is positioned on an outer surface of the chassis base 16 (i.e., on the side on which the drive circuits are mounted). The front cover and the rear cover are interconnected to thereby complete the plasma display apparatus.

The PDP 12 includes a first substrate (hereinafter referred to as a front substrate) 12A and a second substrate (hereinafter referred to as a rear substrate) 12B. The front substrate 12A and the rear substrate 12B are provided in opposition to one another and are sealed in this state. Provided in a gap between the front substrate 12A and the rear substrate 12B so as to form a plasma discharge structure are first electrodes (hereinafter referred to as sustain electrodes) 21, second electrodes (hereinafter referred to as scan electrodes) 23, and address electrodes 25. The sustain electrodes 21 and the scan electrodes 23 are formed along one direction (direction y in FIG. 2), and extend into regions on respective opposite sides of the PDP 12. The address electrodes 25 are formed along a direction substantially perpendicular to the direction along which the sustain electrodes 21 and the scan electrodes 23 extend (direction z in FIG. 2). The address electrodes 25 may extend into either or both of the upper and lower regions of the PDP 12. In this embodiment, the address electrodes 25 extend into the lower region of the PDP 12.

In order to display discharge cells of the PDP 12 in a desired pattern or by a transmitted signal, a drive voltage must be applied to each of these electrodes in a predetermined sequence. The application of the drive voltage may be designated according to predetermined time intervals of a reset period, a scan period, and a (discharge) sustain period. In the reset period, the wall charges of all of the discharge cells are made uniform. In the scan period, the discharge cells where display is to take place are selected, and discharge is effected for these discharge cells. In the sustain period, discharge of the discharge cells selected in the scan period is continuously maintained so as to realize the emission of visible light.

In the scan period, a scan voltage is sequentially applied to the scan electrodes 23 such that discharge occurs between the scan electrodes 23 and the address electrodes 25, thereby selecting the discharge cells where discharge is to take place (discharge at this point is referred to as addressing discharge). Wall charges are accumulated within the selected discharge cells such that, when a discharge sustain voltage is alternatingly applied to the sustain electrodes 21 and the scan electrodes 23 in the subsequent discharge sustain period, display discharge is effected.

Unlike the sustain electrodes 21, which are active only in the discharge sustain period, the scan electrodes 23 are active not only during the discharge sustain period, but also during the reset and scan periods. Therefore, the sustain electrodes 21 and the scan electrodes 23 may differ in both function and formation. In particular, since the same voltage is applied to the sustain electrodes 21 when the sustain electrodes 21 are active only during the discharge sustain period, terminal regions of the sustain electrodes 21 are shorted in proximity to one another, as shown in FIG. 2.

In this exemplary embodiment, non-overlapping edge portions of the front substrate 12A and the rear substrate 12B of the PDP 12 are formed asymmetrically. Such a configuration is adopted on the basis of the electrode formation as described above. That is, the front substrate 12A and the rear substrate 12B form an overlapping region 13D in which they overlie each other, and non-overlapping regions 13X, 13Y, 13A in which no overlapping between the front and rear substrates 12A, 12B occurs. The non-overlapping regions 13X, 13Y, 13A are asymmetrically formed with respect to a center of the PDP 12, and have different widths. The widths of the non-overlapping regions 13X, 13Y, 13A are defined as average distances from corresponding adjacent edges of the overlapping region 13D to outermost edges of the non-overlapping regions 13X, 13Y, 13A.

The width of the non-overlapping region 13Y, into which terminal regions of the scan electrodes 23 extend, is greater than the width of the non-overlapping region 13X, into which terminal regions of the sustain electrodes 21 extend. Preferably, the width of the non-overlapping region 13Y, into which the scan electrodes 23 extend, is greater than the width of the non-overlapping region 13X, into which the sustain electrodes 21 extend by 5 to 30 mm.

Further, the non-overlapping region 13A is formed only in the lower region of the PDP 12 because this is where the address electrodes 25 extend, that is, because the address electrodes 25 do not extend into both upper and lower regions of the PDP 12. The width of the non-overlapping region 13A is sufficient to allow for the required electrical coupling of the address electrodes 25. In the case where a non-overlapping region is also formed in the upper region of the PDP 12, the width of the non-overlapping region 13A is greater than a width thereof by 5 to 30 mm.

Figure 3:
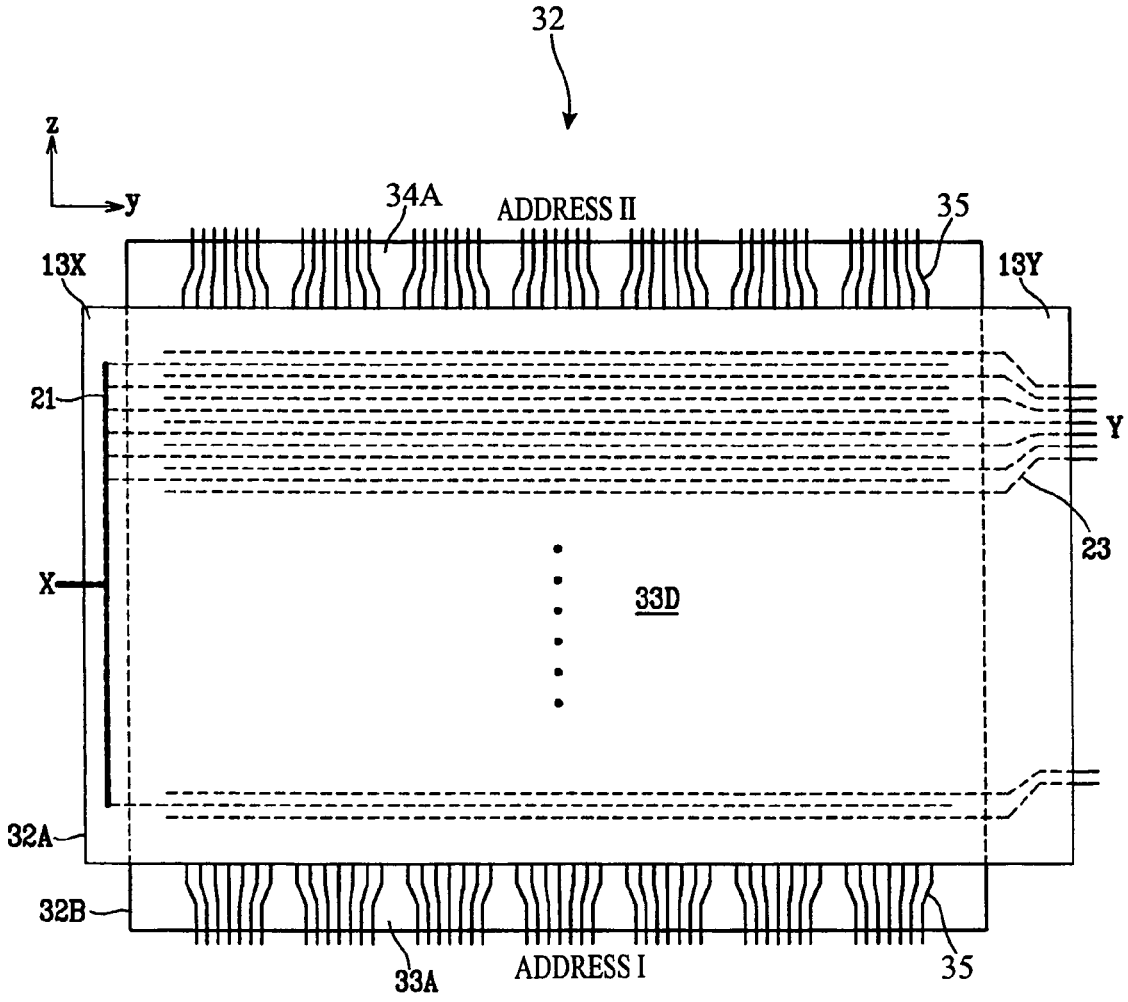
FIG. 3 is a schematic plan view of a PDP according to a second exemplary embodiment of the present invention used to illustrate a mounting structure between front and rear substrates.

FIG. 3 is a schematic plan view of a PDP according to a second exemplary embodiment of the present invention used to illustrate a mounting structure between front and rear substrates. The same reference numerals will be used for elements identical to those of the first exemplary embodiment.

In the second exemplary embodiment, the front substrate 32A and the rear substrate 32B of PDP 32 form an overlapping region 33D in which they overlie each other, and non-overlapping regions 13X, 13Y, 33A, 34A in which no overlapping between the front substrate 32A and rear substrate 32B occurs. The non-overlapping regions 13X, 13Y, 33A, 34A are asymmetrically formed with respect to the center of the PDP 32, and have different widths.

The width of the non-overlapping region 13Y, into which terminal regions of scan electrodes 23 extend, is greater than the width of the non-overlapping region 13X, into which terminal regions of sustain electrodes 21 extend, as in the first exemplary embodiment. However, in this embodiment, address electrodes 35 extend into both upper and lower regions of the PDP 32, and therefore, the non-overlapping regions 33A and 34A are formed in the lower and upper regions, respectively, of the PDP 32. The widths of the non-overlapping regions 33A and 34A are substantially identical. Such a configuration is applied to a dual-scanning PDP where scanning is performed simultaneously in two directions during the scan period.

Figure 4:
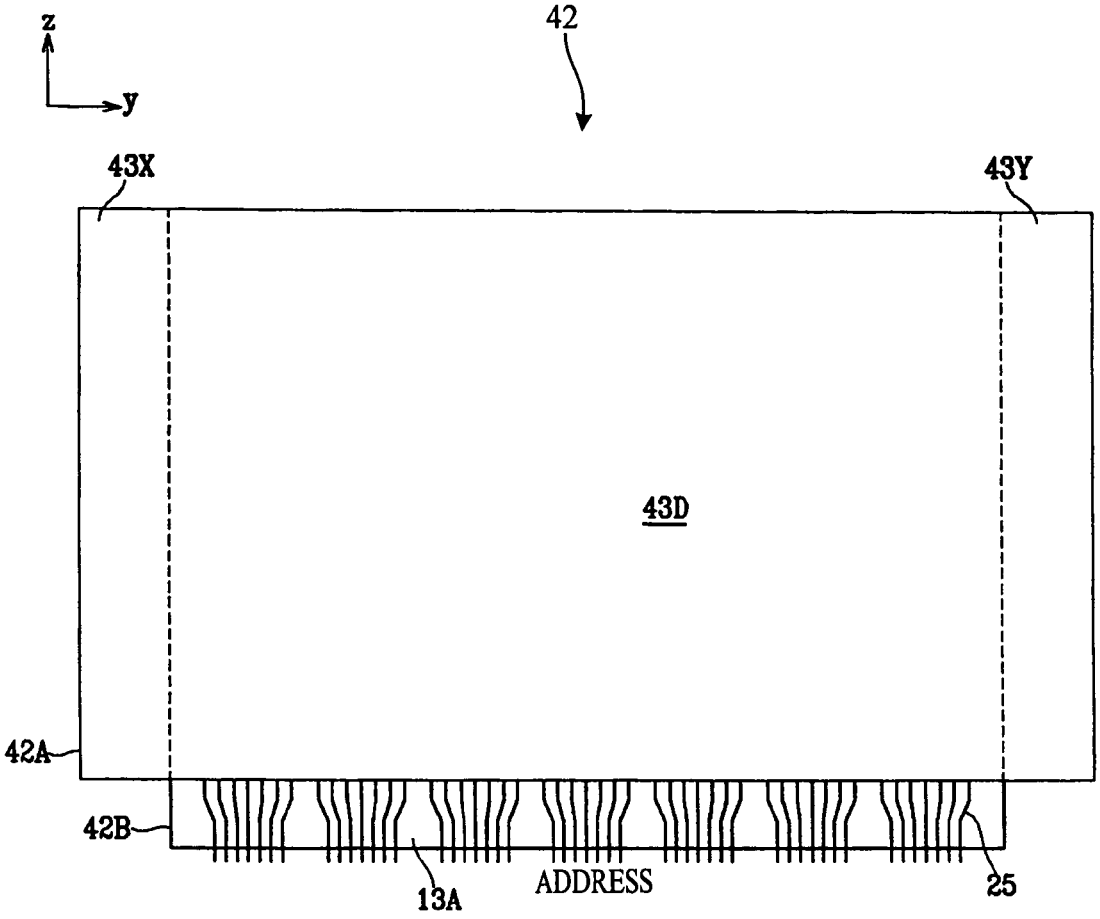
FIG. 4 is a schematic plan view of a PDP according to a third exemplary embodiment of the present invention used to illustrate a mounting structure between front and rear substrates.

FIG. 4 is a schematic plan view of a PDP according to a third exemplary embodiment of the present invention used to illustrate a mounting structure between front and rear substrates. The same reference numerals will be used for elements identical to those of the first exemplary embodiment.

In the third exemplary embodiment, the front substrate 42A and the rear substrate 42B of PDP 42 form an overlapping region 43D in which they overlie each other, and non-overlapping regions 13A, 43X, 43Y in which no overlapping between the front substrate 42A and rear substrate 42B occurs.

As in the first exemplary embodiment, the non-overlapping region 13A is formed only in the lower region of the PDP 42 because this is where address electrodes 25 extend, that is, because the address electrodes 25 do not extend into both upper and lower regions of the PDP 42. The width of the non-overlapping region 13A is sufficient to allow for the required electrical coupling of the address electrodes 25. When a non-overlapping region is also formed in the upper region of the PDP 42, the width of the non-overlapping region 13A is greater than a width thereof by 5 to 30 mm.

In contrast to the first exemplary embodiment, however, the width of the non-overlapping region 43X, into which terminal regions of sustain electrodes (not shown) extend, is substantially the same as a width of the non-overlapping region 43Y, into which terminal regions of the scan electrodes (not shown) extend. Thus, the non-overlapping regions 43X, 43Y are symmetrical about a center of the PDP 42. Such a configuration may be applied to a PDP in which the terminal regions of the sustain electrodes are not shorted, and in which the sustain electrodes individually receive different drive voltages as with the scan electrodes.

In the plasma display apparatus of the present invention described above, the edge regions into which the electrodes extend are optimally formed so that unneeded areas may be removed, thereby allowing the overall size of the plasma display apparatus to be reduced. Manufacturing cost is also minimized as a result.

Although embodiments of the present invention have been described in detail hereinabove, it should be clearly understood that many variations and/or modifications of the basic inventive concepts herein taught, which may appear to those skilled in the present art, will still fall within the spirit and scope of the present invention, as defined in the appended claims.

What is claimed is:

1. A plasma display apparatus, comprising:

a plasma display panel including a first substrate and a second substrate disposed in opposition to each other with a gap formed therebetween, the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates of the plasma display panel form an overlapping region in which the first and second substrates overlie each other, and at least one pair of non-overlapping regions is formed where the first and second substrates do not overlie each other;

wherein the non-overlapping regions are asymmetrically formed about the overlapping region; and wherein the non-overlapping regions have different respective widths, each of the respective widths being formed as an average distance from a corresponding adjacent edge of the overlapping region to an outermost edge of a corresponding non-overlapping region.

2. A plasma display apparatus, comprising:

a plasma display panel including a first substrate and a second substrate disposed in opposition to each other with a gap formed therebetween, the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates of the plasma display panel form an overlapping region in which the first and second substrates overlie each other, and at least one pair of non-overlapping regions is formed where the first and second substrates do not overlie each other; and wherein the non-overlapping regions are asymmetrically formed about the overlapping region;

said apparatus further comprising first and second electrodes formed substantially uniformly with respect to one edge of the plasma display panel and extending into non-overlapping regions on opposite sides of the plasma display panel, terminal regions of the first electrodes being shorted in close proximity to each other; and wherein a width of the non-overlapping region, into which the second electrodes extend, is greater than a width of the non-overlapping region, into which the first electrodes extend.

3. The plasma display apparatus of claim 2, wherein the width of the non-overlapping region into which the second electrodes extend is greater than the width of the non-overlapping region into which the first electrodes extend by an amount in a range of 5 mm to 30 mm.

4. A plasma display apparatus, comprising:

a plasma display panel including a first substrate and a second substrate disposed in opposition to each other with a gap formed therebetween, the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates of the plasma display panel form an overlapping region in which the first and second substrates overlie each other, and at least one pair of non-overlapping regions is formed where the first and second substrates do not overlie each other; and wherein the non-overlapping regions are asymmetrically formed about the overlapping region;

said apparatus further comprising address electrodes which extend into one of the non-overlapping regions, a width of the non-overlapping region into which the address electrodes extend being greater than a width of the non-overlapping region positioned on an opposite side of the plasma display panel.

5. The plasma display apparatus of claim 4, wherein the width of the non-overlapping region into which the address electrodes extend is greater than the width of the non-overlapping region positioned on the opposite side of the plasma display panel by an amount in a range of 5 mm to 30 mm.

6. The plasma display apparatus of claim 4, wherein substantially no non-overlapping region is present on a side of the plasma display panel opposite the non-overlapping region into which the address electrodes extend.

7. A plasma display apparatus, comprising:

a plasma display panel including a first substrate and a second substrate disposed in opposition to each other with a gap formed therebetween, the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates are substantially aligned along at least one side of the plasma display panel;

said apparatus further comprising address electrodes which extend from one edge of the plasma display panel;

wherein a side of the plasma display panel opposite a side corresponding to the is edge from which the address electrodes extend is formed with the first and second substrates being substantially aligned.

8. The plasma display apparatus of claim 7, wherein the first and second substrates of the plasma display panel form an overlapping region in which the first and second substrates overlie each other, and at least one pair of non-overlapping regions is formed where the first and second substrates do not overlie each other.

9. The plasma display apparatus of claim 8, wherein the non-overlapping regions are asymmetrically formed about the overlapping region.

10. The plasma display apparatus of claim 7, wherein the first and second substrates of the plasma display panel form an overlapping region in which the first and second substrates overlie each other, and at least one pair of non-overlapping regions is formed where the first and second substrates do not overlie each other.

11. The plasma display apparatus of claim 10, wherein the non-overlapping regions are asymmetrically formed about the overlapping region.

12. A plasma display apparatus, comprising:

a plasma display panel including a first substrate and a second substrate disposed in opposition to each other with a gap formed therebetween, the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates are substantially aligned along at least one side of the plasma display panel;

wherein the first and second substrates of the plasma display panel form an overlapping region in which the first and second substrates overlie each other, and at least one pair of non-overlapping regions is formed where the first and second substrates do not overlie each other; and wherein the non-overlapping regions have different respective widths, each of the respective widths being formed as an average distance from a corresponding adjacent edge of the overlapping region to an outermost edge of a corresponding non-overlapping region.

13. A plasma display apparatus, comprising:

a plasma display panel including a first substrate and a second substrate disposed in opposition to each other with a gap formed therebetween the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates are substantially aligned along at least one side of the plasma display panel;

said apparatus further comprising first and second electrodes formed substantially uniformly with respect to one edge of the plasma display panel and extending into non-overlapping regions on opposite sides of the plasma display panel, terminal regions of the first electrodes being shorted in close proximity to each other; and wherein a width of the non-overlapping region, into which the second electrodes extend, is greater than a width of the non-overlapping region, into which the first electrodes extend.

14. The plasma display apparatus of claim 13, wherein the width of the non-overlapping region into which the second electrodes extend is greater than the width of the non-overlapping region into which the first electrodes extend by an amount in a range of 5 mm to 30 mm.

15. A plasma display apparatus, comprising:

a plasma display panel including a first substrate and a second substrate disposed in opposition to each other with a gap formed therebetween, the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates are substantially aligned along at least one side of the plasma display panel;

said apparatus further comprising address electrodes; and wherein the address electrodes extend into a non-overlapping region, a width of the non-overlapping region into which the address electrodes extend being greater than a width of another non-overlapping region positioned on an opposite side of the plasma display panel.

16. The plasma display apparatus of claim 15, wherein the width of the non-overlapping region into which the address electrodes extend is greater than the width of the non-overlapping region positioned on the opposite side of the plasma display panel by an amount in a range of 5 mm to 30 mm.

17. The plasma display apparatus of claim 15, wherein substantially no non-overlapping region is present on a side of the plasma display panel opposite the non-overlapping region into which the address electrodes extend.

18. A plasma display apparatus, comprising:

a plasma display panel including a first substrate and a second substrate disposed in opposition to each other with a gap formed therebetween,the plasma display panel having a plasma discharge structure in the gap between the first and second substrates;

a chassis base disposed adjacent to one side of the plasma display panel and substantially parallel to the plasma display panel; and a drive circuit disposed on a side of the chassis base opposite to a side adjacent to the plasma display panel, the drive circuit being electrically connected to the plasma display panel for driving the plasma display panel;

wherein the first and second substrates are substantially aligned along at least one side of the plasma display panel;

said apparatus further comprising first and second electrodes formed substantially uniformly with respect to one edge of the plasma display panel and extending into non-overlapping regions on opposite sides of the plasma display panel, terminal regions of the first electrodes being shorted in close proximity to each other; and wherein a width of the non-overlapping region into which the second electrodes extend is greater than a width of the non-overlapping region into which the first electrodes extend.

* * * * *